United States Patent [19]

Sugimoto

[11] Patent Number: 4,594,505

[45] Date of Patent: Jun. 10, 1986

[54] PHOTOELECTRIC KEY SWITCH DEVICE WITH NOTCHED ROTOR

[75] Inventor: Naoyuki Sugimoto, Koganei, Japan

[73] Assignee: Takigen Seizou Co. Ltd., Tokyo, Japan

[21] Appl. No.: 615,950

[22] Filed: May 31, 1984

[30] Foreign Application Priority Data

Nov. 10, 1983 [JP] Japan ..... 58-174017

[51] Int. Cl.[4] ..... E05B 35/00; H01H 27/00

[52] U.S. Cl. ..... 250/229; 70/DIG. 51; 307/10 AT

[58] Field of Search ..... 250/229, 568; 307/10 AT; 70/DIG. 51, 382–383; 361/173, 176, 177; 340/825.31

[56] References Cited

U.S. PATENT DOCUMENTS 3,870,895 3/1975 Lax et al. ..... 307/10 AT 3,889,501 6/1975 Fort ..... 70/DIG. 51

*Primary Examiner*—Edward P. Westin

*Attorney, Agent, or Firm*—Martin Smolowitz

[57] ABSTRACT

A photoelectric key switch device for preventing error of the output timing of electrical signals from a group of light-receiving elements, while operating an electric processing unit by signals that are simultaneously produced. The device is provided with a rotor having a notch that forms optical paths between the elements of a group of light-emitting and light-receiving elements, other than one set of elements, when a key is inserted into the rotor and the rotor is rotated through a predetermined angle. Another notch forms an optical path between the set of elements and the aforementioned one set of elements when the rotor is additionally rotated through an angle $\alpha$.

4 Claims, 12 Drawing Figures

PHOTOELECTRIC KEY SWITCH DEVICE WITH NOTCHED ROTOR

BACKGROUND OF THE INVENTION

This invention relates to a photoelectric key switch device in which a group of light-receiving elements actuate all together an electric processing circuit.

A photoelectric key switch has been known in the past in which a group each of light-emitting elements and light-receiving elements are disposed on the side of a lock main body so as to oppose one another, while a light transmitting portion and/or light shielding portion is disposed on a key so as to correspond to the arrangement of the light-emitting and light-receiving elements, and when the key is inserted into the lock main body, an electric processing circuit connected to the light-receiving elements is actuated.

In the conventional photoelectric key switch device of the kind described above, however, a light intercepting type rotor is not generally disposed, so that the passage of light from the light-emitting elements to the light-receiving elements is not intercepted. When the key is inserted in the key switch device having such a construction, a group of light transmitting portions and light shielding portion move together with the key, so that the light from the light-emitting elements is repeatedly shielded or transmitted and the electric signal produced from the light-receiving elements does not become constant until the insertion of the key is completed.

Because a minute deviation of position exists between a group of light transmitting portions and light shield portions, it is difficult that the electric signals from a group of light-receiving elements are produced simultaneously. For this reason, the key switch device of this kind is not suitable for electric or electronic appliances which operate only when the electric signals from the group of light-receiving elements are simultaneously applied thereto.

SUMMARY OF THE INVENTION

It is therefore an object of the present invention to provide a photoelectric key switch device which prevents the error of the output timing of electric signals that are produced from a group of light-receiving elements, and lets the signals all together operate an electric processing circuit.

BRIEF DESCRIPTION OF THE DRAWINGS

The accompanying drawings illustrate one embodiment of the invention, in which.

DESCRIPTION OF THE PREFERRED EMBODIMENT

Figure 1:
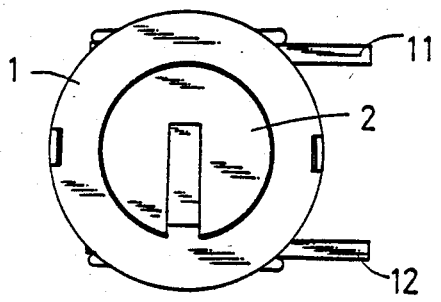
FIG. 1 is a front view of a photoelectric key switch device.
Figure 2:
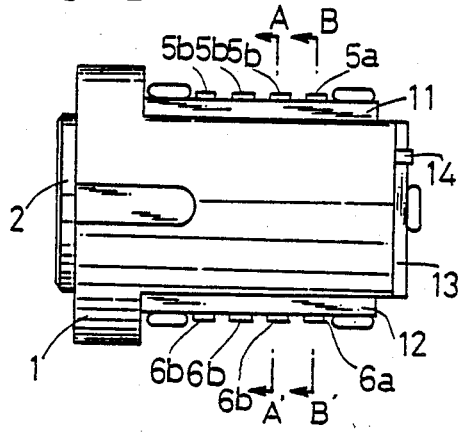
FIG. 2 is a right-hand side view of the key switch device.
Figure 3:
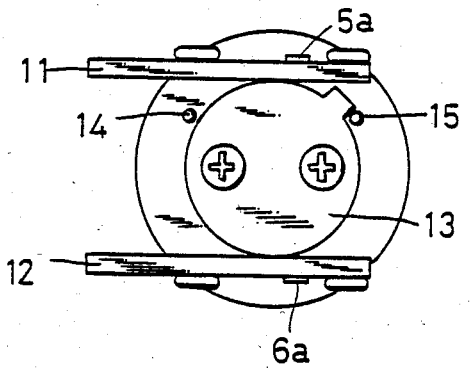
FIG. 3 is a rear view of the key switch device.
Figure 4:
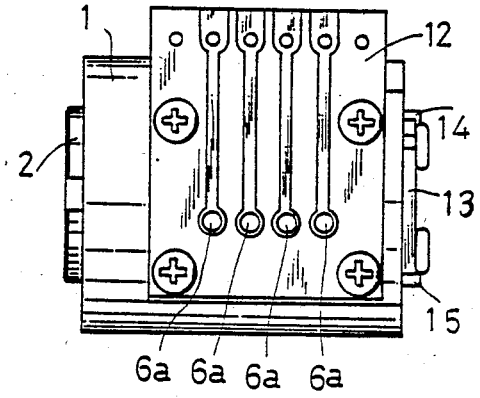
FIG. 4 is a bottom view of the key switch device.
Figure 5:
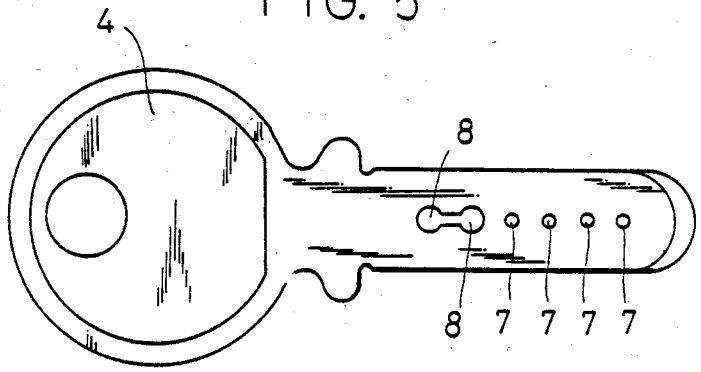
FIG. 5 is a side view of a key used for the device shown in FIG. 1.
Figure 6:
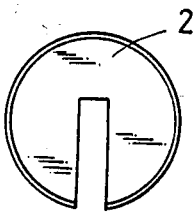
FIG. 6 is a front view of a rotor used for the device shown in FIG. 1.
Figure 7:
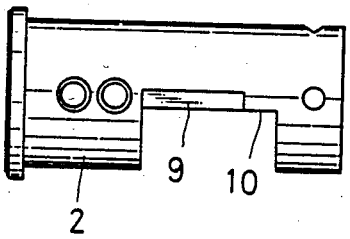
FIG. 7 is a right-hand side view of the rotor.
Figure 8:
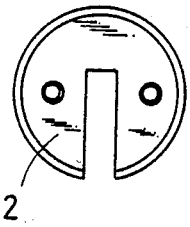
FIG. 8 is a rear view of the rotor.

Hereinafter, a preferred embodiment of the invention will be described with reference to the accompanying drawings.

The photoelectric key switch device in accordance with the present invention comprises a lock main body 1, a rotor 2 incorporated in the lock main body 1, a lock member 3 which locks the rotor 2 to the lock main body 1 so that the rotor 2 does not rotate, a key 4 which, when inserted into the rotor 2, drives the lock member 3 and unlocks the rotor 2, and a group each of light-emitting elements 5 and light-receiving elements 6 disposed on both sides of the lock main body 1 so as to oppose one another. The rotor 2 is arranged so as to cut off the passage of light from the light-emitting elements 5 to the light-receiving elements 6. A group of light transmitting portions 7 and/or light shielding portions 7 are disposed on the key 4 in such a manner as to correspond to the arrangement of the light-emitting and light-receiving elements 5 and 6, respectively. A notch 9 is formed on the rotor 2 so that when the key 4 is inserted into the rotor 2 and is rotated by a predetermined angle A, the notch 9 forms the optical path between all the light-emitting and light-receiving elements *5b, 6b* other than one set of light-emitting and light-receiving elements *5a, 6a*. Another notch 10 is likewise formed on the rotor 2 so that when the rotor 2 is further rotated by an angle $\alpha$, the notch 10 forms the optical path between the elements *5a, 6a* that are excluded as described above.

In the embodiment described above, four each light-emitting and light-receiving elements 5 and 6 are shown disposed and fixed to substrates 11 and 12 respectively, that are disposed so as to oppose the lock main body 1. A cam 13 is disposed on the rear of the rotor 2, and the angle of rotation of the rotor 2 is restricted to 90° by protuberances 14, 15 that are disposed on the back of the lock main body 1. This embodiment uses a pin tumbler mechanism as the lock member 3, though a disc tumbler, a pin tumbler, an axial pin tumbler or the like may be used. The pin tumbler 3 releases the lock of the rotor 2 to the lock main body 1 in cooperation with a recess 8 on the side of the key 4.

Figure 9:
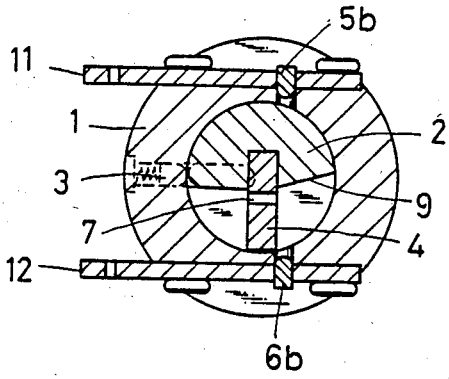
FIG. 9 is a sectional view taken along line A—A′ of FIG. 2 when the key is inserted into the key switch device of FIG. 1.
Figure 10:
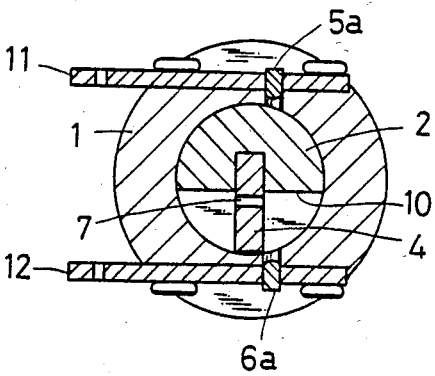
FIG. 10 is also a sectional view taken along line B—B′ of FIG. 2 when the key is inserted into the device.

Under the lock state shown in FIG. 9, the passage of light from the light-emitting elements 5 to the ligh-receiving elements 6 is completely intercepted by the rotor 2 stored in the lock main body 1. Here, if the key 4 is fully inserted into the rotor 2 till the predetermined position, the lock member 3 unlocks the rotor 2 so that the rotor 2 becomes rotatable inside the lock main body 1.

Figure 11:
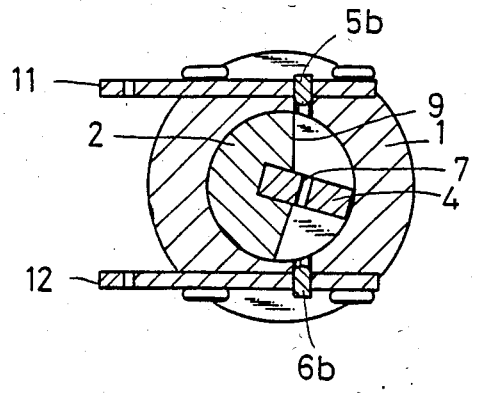
FIG. 11 is a sectional view taken along line A—A′ when the key is rotated to 75°.

Next, when the key 4 is rotated as shown in FIG. 11, the rotor 2 rotates together with the key 4 and when it rotates through an angle A (about 75°), the notch 9 forms the optical path for all the elements *5b, 6b* other than one set of elements *5a, 6a*, so that the light starts transmitting from a plurality of light-emitting elements *5b* corresponding to the light transmitting portions 7 disposed on the key 4 to the light-receiving elements *6b*.

Before the rotor rotates further through an angle $\alpha$ (about 10°), all the light-emitting elements 5b, that are placed at the positions corresponding to the light transmitting portions 7, transmit the light to the respective light-receiving elements 6b.

Figure 12:
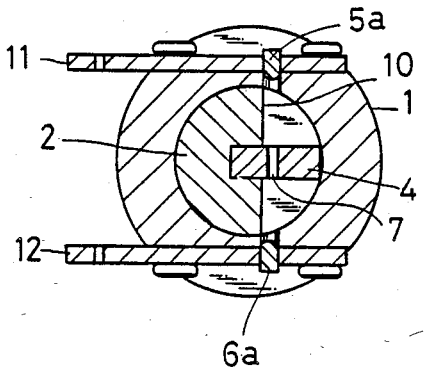
FIG. 12 is a sectional view taken along line B—B′ when the key is rotated to 90°.

As described above, when the rotor rotates additionally through the angle $\alpha$, that is, by about 85° in total as shown in FIG. 12, the notch 10 forms the optical path for the final one set of elements 5a and 6a, so that the light is transmitted from the light-emitting element 5a to the light-receiving element 6a. By using the electric signals produced from the light-receiving element 6a as a switching means, the deviation of the output timing of the electric signals produced from the group of the light-receiving elements 6b can be prevented.

It is generally reasonable to employ a construction in which the optical path between the elements 5 and 6 is formed by the notch 9 when the rotor 2 is rotated through about 75° from the lock position or by the notch 10 when the rotor 2 is rotated through about 85°. However, these angles can be suitably increased or decreased in the present invention without being limited to the above-mentioned values, in particular. A wide variety of key switch devices can be produced by changing the numbers and positions of arrangement of the elements 5 and 6.

As described above, the photoelectric key switch device in accordance with the present invention includes the rotor 2 equipped with the notch 9 that forms the optical path between all of a group each of light-emitting elements 5b and light-receiving elements 6b except one set of elements 5a, 6a, and with the notch 10 that belatedly forms the optical path between the set of the elements 5a, 6a, the rotor 2 being incorporated in the lock main body 1. According to this arrangement, the element 6a that finally receives the light is used as a switch or trigger means so as to simultaneously produce the electric signals from the group of the light-receiving elements 6 and thus to prevent the error of the output timing of the electric signals that are produced from the light-receiving elements 6.

What is claimed is:

1. A photoelectric key switch device comprising:

a lock main body;

a rotor incorporated in said lock main body;

a lock member for locking said rotor to said lock main body so that said rotor can not be rotated;

a key inserted into said rotor and driving said lock member to unlock said rotor;

a group each of light-emitting elements and light-receiving elements, arranged on both sides of said lock main body in such a manner as to oppose one another, said rotor being disposed so as to intercept the passage of light from said light-emitting elements to said light-receiving elements;

a group of light transmitting portions and/or light intercepting portions disposed on said key in such a manner as to correspond to the arrangement of said light-emitting and light-receiving elements;

a notch formed on said rotor so that when said key is inserted into said rotor and said rotor is rotated by a predetermined angle, said notch forms optical paths between all of the elements of said group of light-emitting and light-receiving elements except one set of said elements; and another notch formed on said rotor so that when said rotor is further rotated by an angle $\alpha$, said another notch forms an optical path between said one set of elements.

2. A photoelectric key device according to claim 1, wherein the rotation of said rotor is restricted to about 90° by cam means disposed on the rotor rear end and contacting protuberances on said lock main body.

3. A photoelectric key device according to claim 1, wherein said predetermined angle is about 75°.

4. A photoelectric key device according to claim 1, wherein said angle $\alpha$ is about 10°.

* * * * *